US010252782B1

(12) United States Patent
Connors

(10) Patent No.: US 10,252,782 B1
(45) Date of Patent: Apr. 9, 2019

(54) WATER SKI LAUNCH DEVICE

(71) Applicant: Kip Connors, Anaheim, CA (US)

(72) Inventor: Kip Connors, Anaheim, CA (US)

( * ) Notice: Subject to any disclaimer, the term of this patent is extended or adjusted under 35 U.S.C. 154(b) by 889 days.

(21) Appl. No.: 14/828,015

(22) Filed: Aug. 17, 2015

Related U.S. Application Data

(60) Provisional application No. 62/034,229, filed on Aug. 7, 2014.

(51) Int. Cl.
*B63B 35/85* (2006.01)

(52) U.S. Cl.
CPC ..... *B63B 35/85* (2013.01)

(58) Field of Classification Search
CPC ..... B63B 35/85
USPC ..... 114/253, 254
See application file for complete search history.

(56) References Cited

U.S. PATENT DOCUMENTS 2,821,726 A * 2/1958 Correll ..... B63B 35/85 104/53
3,886,888 A * 6/1975 Parsons ..... B63B 35/816 114/254
3,919,963 A * 11/1975 Cox, III ..... B63B 35/816 114/253
D355,634 S * 2/1995 Ritzenthaler ..... D12/317

* cited by examiner

*Primary Examiner* — Stephen P Avila
(74) *Attorney, Agent, or Firm* — Global Intellectual Property Agency, LLC; Daniel Boudwin

(57) ABSTRACT

A water ski launch device for use with a boat. The water ski launch device includes a launch tube having an L-shaped configuration, a first end, a second end, and a hollow interior volume. A winch is secured to the launch tube, wherein a cable is wound on the winch and extends through the interior of the launch tube. The cable passes through the second end of the launch tube and includes a handle on an end thereof. The first end of the launch tube is affixed to a launch base, wherein the launch base can be removably connected to the swim step at the rear of a boat. A launch tray is pivotally secured to the launch base and a user can position his or her water skis thereon so that the user can stabilize himself in an upright position in order to begin water skiing.

4 Claims, 3 Drawing Sheets

WATER SKI LAUNCH DEVICE

BACKGROUND OF THE INVENTION

Field of the Invention

The present invention relates to a water ski launch device. More specifically, the present invention provides a water ski launch device securable to a swim step at the rear of a boat for helping a water skier to more easily begin water skiing by allowing the water skier to start from an upright position at the rear of a moving boat. The water ski launch device includes a launch tube having an L-shaped configuration, wherein the launch tube is disposed on a launch base. A cable having a handle on an end thereof is wound on a winch affixed to the launch tube, wherein the cable extends through the launch tube. The launch base comprises a pivoting launch tray on which a water skier can stand in order to begin water skiing.

Water skiing and wakeboarding are popular sports wherein the water skier or wakeboarder ride, herein referred to simply as water skier, on a board or pair of skis in the wake of a boat that is towing the water skier. While water skiing can be exciting and enjoyable, it can be extremely difficult for beginners to learn. In order to water ski, the skier must bring himself or herself into an upright position on his or her skis while being towed through a body of water. It can be difficult to balance on the skis while also working against the force of the water flowing past the skier's body. As a result, some water skiers become frustrated from their inability to move into an upright position and may lose interest in the sport. Thus, a launching device for allowing a water skier to more easily bring himself or herself into an upright position is desired.

While various devices in the prior art have been disclosed that relate to devices for use by water skiers, such devices fail to provide a means for allowing a user to stand in an upright position on water skis at the rear of a boat. The present invention allows the user to begin water skiing from an upright position so as to eliminate the need for the user to raise himself or herself into an upright position from the water.

SUMMARY OF THE INVENTION

In view of the foregoing disadvantages inherent in the known types of water ski assist devices now present in the prior art, the present invention provides a new water ski launch device wherein the same can be utilized for providing convenience for the user when helping a user to begin water skiing.

It is therefore an object of the present invention to provide a new and improved water ski launch device comprising a launch tube having an L-shaped configuration, wherein a cable on a winch extends through the launch tube and comprises a handle on an end thereof for the user to hold.

It is another object of the present invention to provide a water ski launch device comprising a launch base affixed to a first end of the launch tube, wherein the launch base is adapted to support a user's water skis or wakeboard thereon to help a water skier stabilize himself in an upright position.

Another object of the present invention is to provide a water ski launch device comprising a launch base having a pivoting launch tray thereon.

Yet another object of the present invention is to provide a water ski launch device a water ski launch device that is securable to the swim step at the rear of a boat.

Another object of the present invention is to provide a water ski launch device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
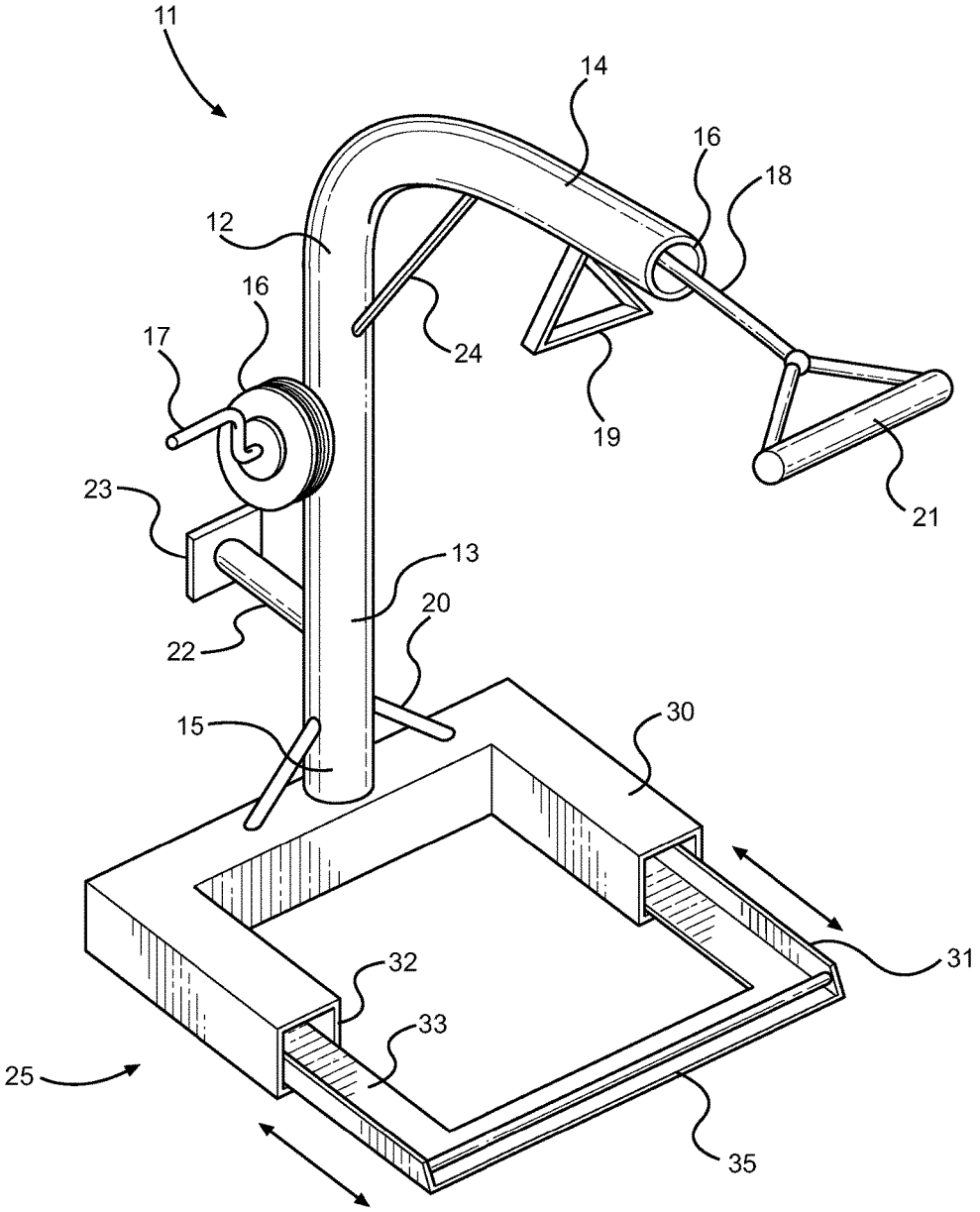
FIG. 1 shows a perspective view of the water ski launch device.

Reference is made herein to the attached drawings. Like reference numerals are used throughout the drawings to depict like or similar elements of the water ski launch device. For the purposes of presenting a brief and clear description of the present invention, the preferred embodiment will be discussed as used for helping a user to begin water skiing from an upright position at the rear of a boat. The figures are intended for representative purposes only and should not be considered to be limiting in any respect.

Figure 2:
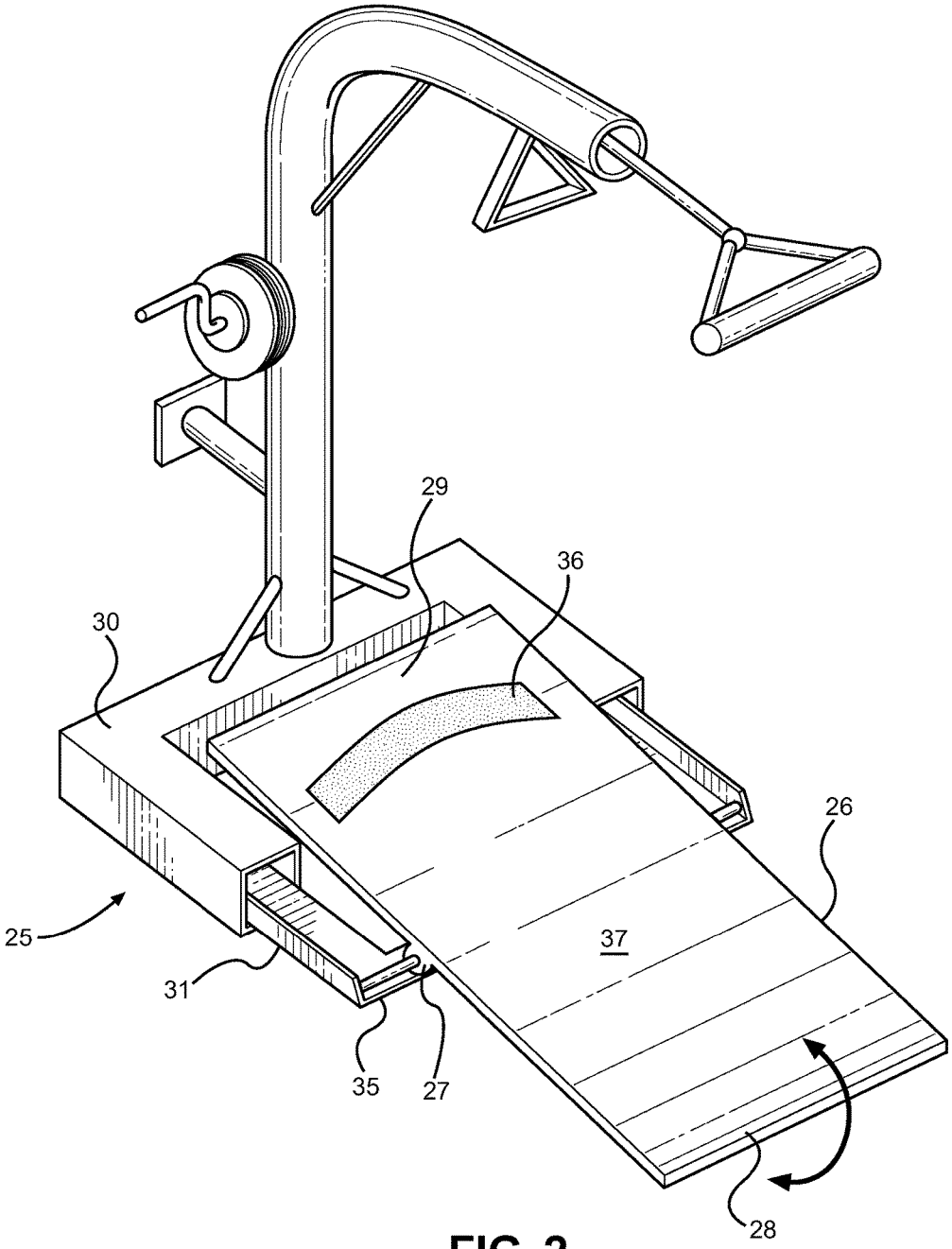
FIG. 2 shows a perspective view of the water ski launch device having a launch tray thereon.

Referring now to FIGS. 1 and 2, there is shown a perspective view of the water ski launch device and a perspective view of the water ski launch device having a launch tray thereon, respectively. The water ski launch device 11 comprises a launch tube 12 having a first end 15 and a second end 16. The launch tube 12 comprises an L-shaped configuration so that the launch tube includes a vertical section 13 and a horizontal section 14. In some embodiments, a support arm 24 connects between the vertical section 13 and the horizontal section 14 so as to stabilize and secure the horizontal section 14. The launch tube 12 comprises a hollow interior volume so that a cable 18 can be passed therethrough. In the illustrated embodiment, the launch tube 12 comprises a circular cross section, however in alternate embodiments, the launch tube 12 includes various cross sectional shapes.

A winch 16 is secured to the vertical section 13 of the launch tube 12, wherein a cable 18 is wound therearound. A crank 17 is operably connected to the winch 16 that allows a user to easily extend the cable 18 therefrom or wind the cable 18 onto the winch 16. In some embodiments, the winch 16 is adjustably secured to the launch tube 12 so that the winch 16 can be raised or lowered along the launch tube 12 as desired by the user. The cable 18 extends through the hollow interior volume of the launch tube 12 towards the second end 16 thereof. The free end of the cable 18 passes through the second end 16 and includes a handle 21 thereon for the user to hold while water skiing. The handle 21 preferably comprises an elongated bar affixed in having the cable 18 connected to a central portion thereof so that the user can hold the handle 21 with both hands. In some embodiments, a fixed handle 19 is secured to the launch tube 12 adjacent to the second end 16 thereof so as to provide a water skier with an additional handle to grasp while preparing to water ski.

In some embodiments, the launch tube 12 further includes a support arm 22 that extends perpendicularly from the launch tube 12. The support arm 22 extends the opposite direction of the second section 14 of the launch tube 12 so that the support arm 22 can be secured to the rear of a boat, while the second section 14 of the launch tube 12 extends outwards and away from the boat. The support arm 22 includes a bracket 23 thereon adapted to be affixed to the exterior of the rear of the boat. The bracket 23 can be affixed to the boat via any suitable fasteners, such as bolts and screws, among others. In this way, the launch tube 12 is further stabilized and secured to the boat.

The first end 15 of the launch tube 12 is affixed to a launch base 25. The launch tube 12 extends vertically upwardly from the launch base 25, and the launch base 25 is substantially perpendicular to the first section 13 of the launch tube 12, such that the launch base 25 is arranged in a horizontal orientation. The second section 14 of the launch tube 12 is substantially parallel to the launch base 25. The first end 15 of the launch tube 12 may further include one or more struts 20 connecting the launch tube 12 to the launch base 25 so as to provide support and reinforcement in order to stabilize the launch tube 12.

The launch base 25 is adapted to be secured to the swim step at the rear of a boat. The launch base 25 is configured to be secured to any of various types of boats and swim steps. The launch base 25 can be placed on top of the swim step and secured thereto using any fastening method, such as by means of screws, bolts, brackets, and any of various other conventional securement devices or methods.

The launch base 25 comprises a first section 30 secured to the rear of the boat and a second section 31 slidably connected to the first section 30. The second section 31 can be extended outwardly from the first section so as to increase the length of the launch base 25. The launch base 25 may be desired to be extended depending upon the size of the user and the length of his or her water skis. In the illustrated embodiment, the first section 30 comprises a U-shape with a pair of outwardly extending arms 32. The arms 32 have an open end and a hollow interior volume so as to receive the arms 33 of the second section 31. Similarly, the second section 31 includes a U-shape with a pair of arms 33 that are slidably positioned within the arms 32 of the first section 30. In this way, the launch base 25 comprises a substantially rectangular configuration so as to support a user's skis or board thereon.

A launch tray 26 is pivotally affixed to the launch base 25 via a hinge 27. The hinge 27 is disposed on the underside of the launch tray 26 at a substantial midpoint thereof. The hinge 27 is positioned substantially centrally on the launch tray 26 so that the launch tray 26 can pivot in forward and rearward directions. Further, the hinge 27 is positioned on the second section 31 of the launch base 25 at an end 35 thereof. When the user desires to begin water skiing, the user can start in an upright, standing position and tilt the launch tray 26 rearward by shifting his or her weight in order to allow the water skis to slide off of the launch tray 26 and into the water.

The launch tray 26 comprises a substantially solid panel on which a user may position his or her water skis prior to launching from the boat. The launch tray 26 comprises a first end 28 and a second end 29. The second end 29 comprises a strap 36 thereon that is adapted to temporarily hold a user's water skis or wakeboard so as to help stabilize the user thereon. The upper surface 37 of the launch tray 26 preferably comprises padding composed of neoprene or other similar substance.

Figure 3:
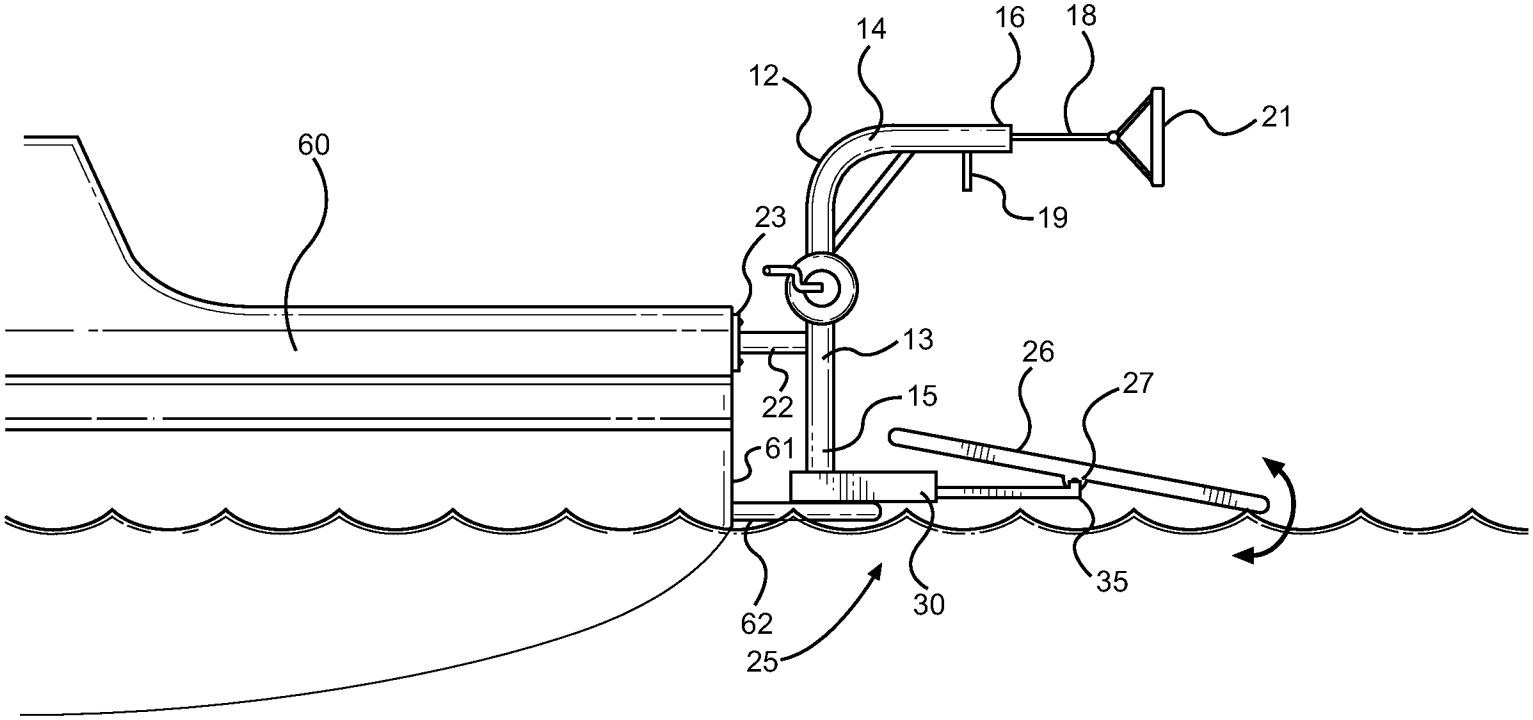
FIG. 3 shows a side view of the water ski launch device as secured to the rear of a boat.

Referring now to FIG. 3, there is shown a side view of the water ski launch device as secured to the rear of a boat. In operation, the launch base 25 can be positioned on and affixed to the swim step 62 at the rear 61 of a boat 60 using any suitable fasteners or fastening methods. The launch tube 12 is affixed to the launch base 25, wherein a first section 24 thereof extends vertically upward from the launch base 25 and a second section 14 of the launch tube 12 extends horizontally. A support arm 22 that extends from the launch tube 12 can be affixed to the rear 61 of the boat 60 via a bracket 23 thereon in order to further secure the water ski launch device thereto.

Once the water ski launch device has been installed, a user can position his or her wakeboard or water skis on the launch tray 26. The launch tray 26 is positioned on the launch base 25 that extends from the rear of the boat and rests on the surface of the water. The user can then hold the handle 21 on the end of the cable 18 that extends through the launch tube 12 and that is wound on the winch 16 in order to assume a starting position.

The user positioned on the launch tray 26 can then be tilt the launch tray 26 in a rearward direction so as to allow the user's skis or wakeboard to slide into the water behind the launch tray 26. The cable 18 can be extended from the launch tube 12 by unwinding the cable from the winch so as to allow the user to separate himself or herself from the boat. In this way, the water ski launch device allows a user to more easily begin to water ski from an upright, standing position. This eliminates the need for a user to raise his or her body into an upright position while in the water, which can be challenging and frustrating.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water ski launch device for use with a boat, comprising:

a launch base adapted to be secured to said rear portion of said boat, wherein said launch base is adapted to support a water skier thereon in an upright orientation;

wherein said launch base comprises a first section and a second section, wherein said second section is slidably secured to said first section such that said second section can be extended outwardly from said first section so as to extend the length of said launch base;

a launch tube having an L-shaped configuration, wherein said launch tube comprises a first end and a second end, said first end affixed to said launch base;

said launch tube comprises an open second end and a hollow interior volume;

a winch affixed to said launch tube, wherein said winch comprises a cable thereon, said cable having a free end;

said cable extends outward from said second end of said launch tube, and comprises a handle on said free end thereof.

2. The water ski launch device of claim 1, wherein said launch tube comprises a first section and a second section, wherein said first section is perpendicular to said launch base, and wherein said second section is substantially parallel thereto.

3. The water ski launch device of claim 1, wherein said launch tube further comprises a support arm adapted to be affixed to a rear of said boat in order to stabilize said launch tube.

4. The water ski launch device of claim 1, further comprising a launch tray pivotally affixed to said launch base, wherein said launch tray is adapted to support a water skier thereon.

* * * * *